United States Patent [19]

Boring

[11] Patent Number: 4,974,699

[45] Date of Patent: Dec. 4, 1990

[54] LADDER SAFETY DEVICE

[76] Inventor: Clair W. Boring, 723 Center Ave., Butler, Pa. 16001

[21] Appl. No.: 348,894

[22] Filed: May 8, 1989

[51] Int. Cl.[5] ..... E06C 7/48

[52] U.S. Cl. ..... 182/107; 182/214

[58] Field of Search ..... 182/107, 214, 198, 197, 182/206, 108

[56] References Cited

U.S. PATENT DOCUMENTS

| | | | |
|---|---|---|---|
| 2,904,128 | 9/1959 | Boham et al. | 182/108 |
| 4,491,192 | 1/1985 | Skarsten | 182/107 |
| 4,726,446 | 2/1988 | Perbix | 182/107 X |
| 4,754,843 | 7/1988 | Anderson | 182/214 X |

FOREIGN PATENT DOCUMENTS

| | | | |
|---|---|---|---|
| 1176611 | 10/1984 | Canada | 182/108 |
| 1116712 | 5/1956 | France | 182/108 |
| 82771 | 10/1919 | Switzerland | 182/214 |

*Primary Examiner*—Karen J. Chotkowski

*Attorney, Agent, or Firm*—George C. Atwell

[57] ABSTRACT

A safety device for stabilizing the upper end of a ladder against the exterior wall of a building or other resting surface comprising a tubular body of a length greater than the typical ladder width and having coaxial and coextensive inner and outer contiguous tubular sections. The inner tubular section is a normally rigid temporarily deformable member and the other tubular section is a resilient slip-resistant sheath. The tubular body is provided with spaced-apart longitudinally aligned openings permitting insertion-registration of ends of the ladder stiles, and straps are provided for removably securing the device to the ladder.

10 Claims, 3 Drawing Sheets

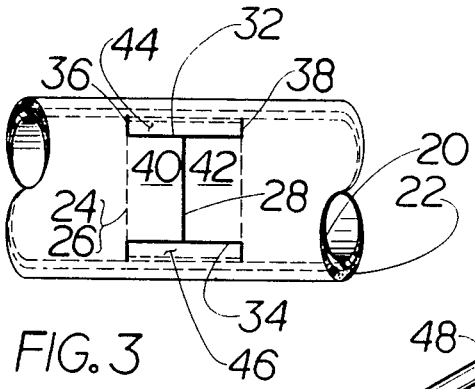
FIG. 3
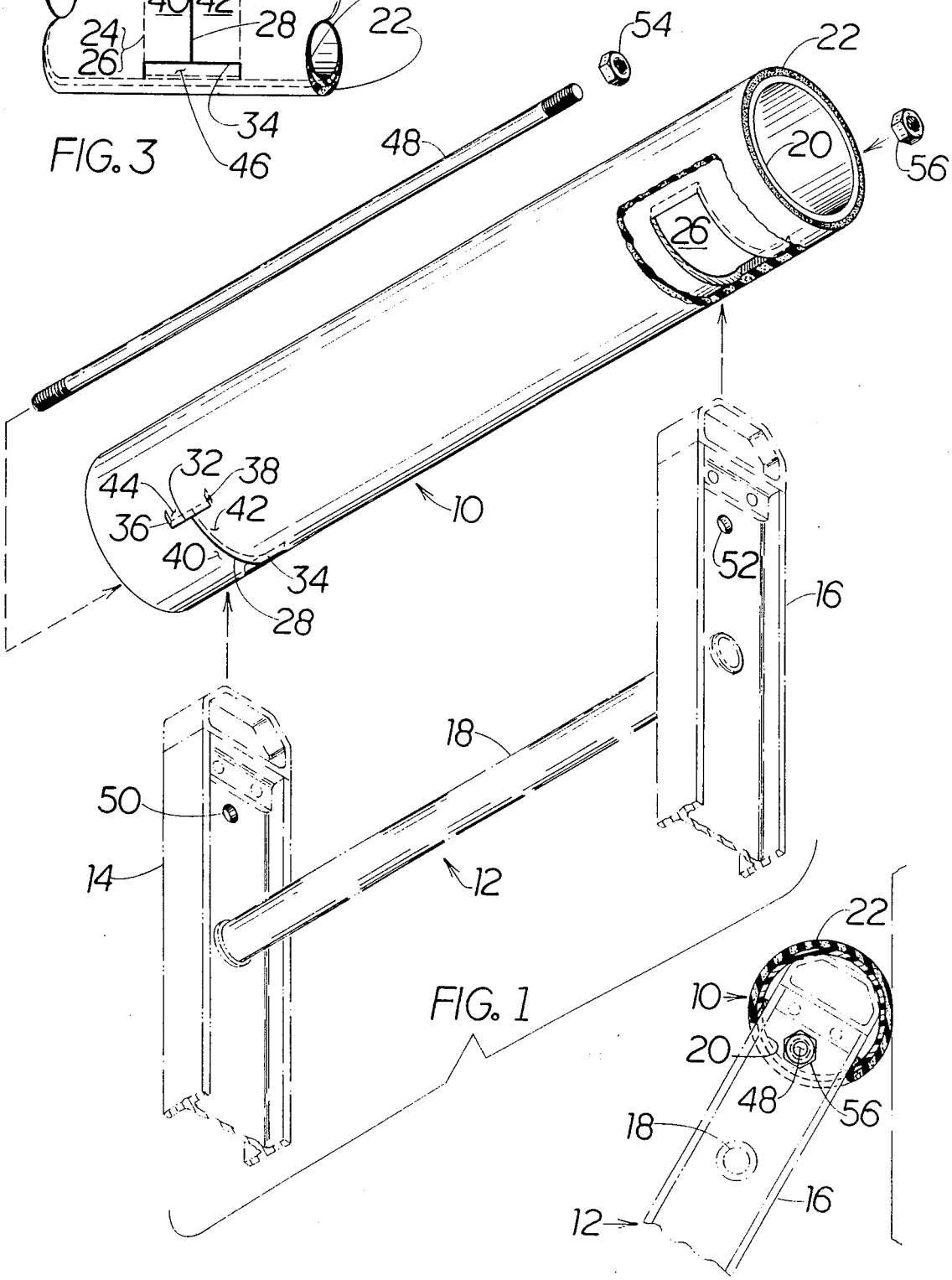
FIG. 1
FIG. 2

LADDER SAFETY DEVICE

BACKGROUND OF THE INVENTION

This invention relates generally to ladder safety devices and particularly pertains to devices for use on the upper end of the type of ladder having a pair of parallel side members of stiles with equispaced transverse rungs.

In the prior art, a number of different ladder safety devices have been provided which can be secured to the upper ends of ladder stiles to increase the area of contact between the upper end of the ladder and the building wall or other resting surface and thereby reduce the risk of ladder slippage. Typical of such apparatus is that which is disclosed in U.S. Pat. No. 4,491,192 wherein a safety device is provided for transverse installation across the end of a ladder and comprises a pair of elongated telescopically slidable members. Another such device is disclosed in U.S. Pat. No. 4,580,661 which utilizes a foam block attachable to the ladder in a transverse position inward from the stile ends and which is particularly adapted to conform with and stabilize the ladder against a roof edge gutter. In U.S. Pat. No. 4,469,194, a rung-attached device is disclosed for use at the end of a ladder and includes a sponge-like member adapted to extend outwardly from the ladder and to be oriented at a selected angle relative to the ladder by means of adjustable clamps on the rung.

The aforementioned prior art devices, and many others not herein discussed which have been introduced for ladder stabilization, have proved extremely useful in providing greater safety for the ladder user. Such devices often, however, are intended for a specific use and lack universality, are quite often costly and cumbersome, and may ignore such factors as protection of the surface against which the ladder is rested or the concept of spreading the area of contact laterally whereby stabilization of the ladder is greatly improved, particularly as compared to that obtainable when only the ladder stile ends contact the resting surface.

SUMMARY OF THE INVENTION

The present invention comprehends a ladder safety device which accomplishes and fulfills a number of worthwhile objectives, including slip resistance, general universal application to different types of ladders, inexpensive cost of manufacture, and rapid installation and removal.

In addition to the above, the structure of the present invention achieves the objective of providing comparatively greater stabilization by a slip resistance characteristic which increases in direct proportion to the weight of the user on the ladder, and this is accomplished while avoiding scuffing or marring of the surface against which the device is placed.

A still further and equally important objective which is accomplished by the present invention is its effectiveness in accomplishing the functions heretofore described regardless of the angle of the ladder relative to the surface against which it is rested.

The safety device of the present invention, which is intended for use in combination with a ladder of the type having a pair of parallel stiles and equidistantly-spaced rungs, includes a tubular body, of a length longer than the typical ladder width, and comprising coaxial and coextensive inner and outer contiguous tubular members or sections. Spaced-apart longitudinally-aligned sidewall openings are provided in the body to enable insertion-registration of the ends of the ladder stiles. The outer section of the body is a resilient skid-resistant sleeve or sheath, and the inner section is preferably normally rigid but susceptible to temporary deformation during use. Alternative means are provided for removably securing the body member in its operative position on the ladder.

More specific details of the structure of the presently preferred embodiments of the invention are set forth in the ensuing detailed description and shown in the accompanying drawings, a full understanding of which will enable an appreciation of the advantages and features of the disclosed invention.

BRIEF DESCRIPTION OF THE DRAWING

FIG. 1 is an isometric illustration of a first preferred embodiment of the present invention showing the ladder safety device prior to its installation on a ladder;

FIG. 2 is a cross-sectional view of the device of the invention first shown in FIG. 1, showing the device in its operative position;

FIG. 3 is a fragmentary side elevational view of the device first shown in FIG. 1;

DETAILED DESCRIPTION OF THE PREFERRED EMBODIMENTS

I. Structure

Figure 5:
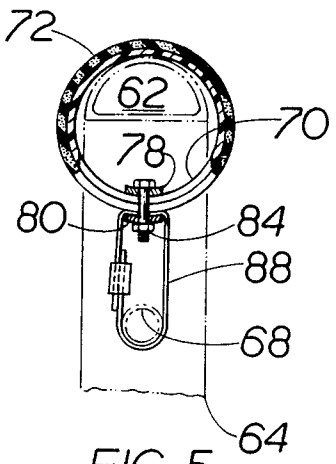
FIG. 5 is a sectional view taken along lines V—V of FIG. 4.

In FIG. 1 there is shown a ladder safety device 10 adapted to function in cooperation with a ladder 12. The ladder 12 may be a typical extension ladder comprising parallel spacedapart side members or stiles 14 and 16 separated by a plurality of equispaced laterally extending rungs, with the end rung 18 being shown in FIG. 1.

The primary component of the device 10 is a tubular member or body comprised of a rigid inner tubular section 20 and an outer sleeve or sheath 22 of compressible resilient material. Along the sidewall of the tubular section 20 are two spaced-apart longitudinally-aligned rectillinear openings 24 and 26 which accommodate the insertion therethrough of the respective ends of stiles 14 and 16. The sidewall areas of the sheath section 22 which directly overlie the openings 24 and 26 are slit in a specific pattern whereby flaps of the sheath material will fold inwardly as a function of the insertion of the stile through the opening.

More specifically, FIG. 3 shows that the sheath section 20, in the area across the opening 24, is provided with a transverse slit 28 which merges at each of its ends with respective longitudinal slits 44 and 46. Each of the longitudinal slits 44 and 46 terminate at their two ends with short slits 36 and 38. This slit arrangement provides major flaps 40 and 42 and minor flaps 44 and 46 in the sheath material which will fold inwardly as the stile end is inserted through the opening 24. These flaps serve as lateral cushions between the edges of the opening 24 and the surface of the ladder stile.

FIGS. 1 and 2 illustrate a means of removably securing the device 10 onto the ladder 12, including a rod 48 threaded at each of its ends and which, when the device is placed onto the ladder 12, with the stiles extended upwardly through the openings 24 and 26 as shown in FIG. 2, in inserted inwardly through the tubular section 20 from one of its ends and through openings 50 and 52 provided in the ladder stiles 14 and 16. Nuts 54 and 56 are then fixed at each end of the rod 48 which is positioned whereby the rod ends extend outwardly from each of the openings 50 and 52.

Figure 4:
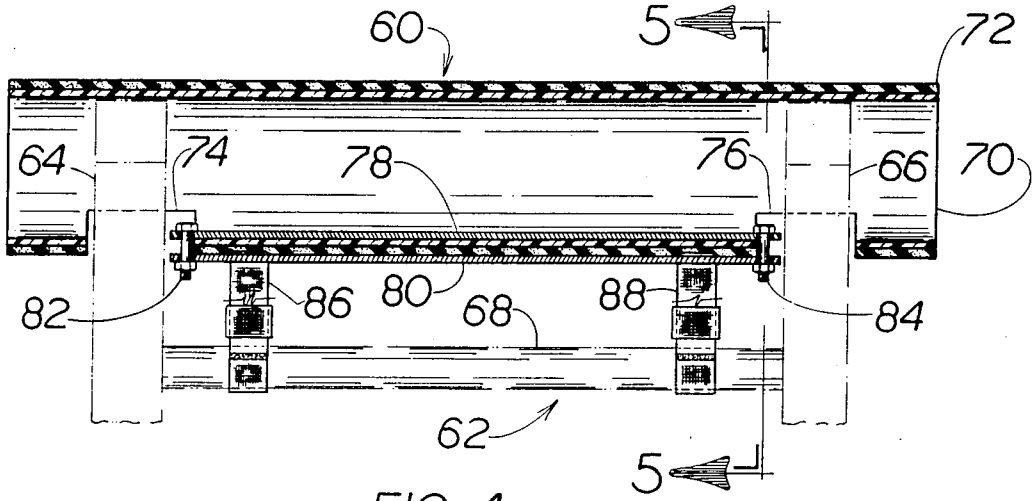
FIG. 4 is an illustration of a second presently preferred embodiment of the present invention showing the device of the invention in horizontal cross-section.

FIGS. 4 and 5 illustrate a modified form or alternate embodiment of the present invention. More specifically, FIG. 4 illustrates a ladder safety device 60 mounted on a ladder 62. The ladder 62 includes spaced-apart stiles 64 and 66 interconnected by an end rung 68. The device 60 includes an inner tubular section 70 and an exterior sheath 72. Openings 74 and 76 are provided through the sidewalls of the tubular section 70 and the sheath 72 to accommodate extension therein of the ends of stiles 64 and 66. The means of attaching the device 60 to the ladder 62, as shown in FIG. 4, includes an elongated rod or plate 78 contained within the tubular section 70 and between the openings 74 and 76, and an exterior elongated rod or plate 80.

The opposite ends of the plates 78 and 80 extend into the openings 74 and 76 where respective fastening means 82 and 84 extend through accommodating apertures to hold the plates 78 and 80 in the position shown in FIGS. 4 and 5. Extending between the rung 62 and the plate 80 are a pair of spaced-apart strap means 86 and 88 which serve to retain the device 60 firmly in its mounted position on the ladder 62. In the preferred embodiment of the device 60 shown in FIG. 4, the strap means 86 and 88 utilize easily releasable fasteners of the plastic hook and loop type sold under the tradename "Velcro".

Figure 6:
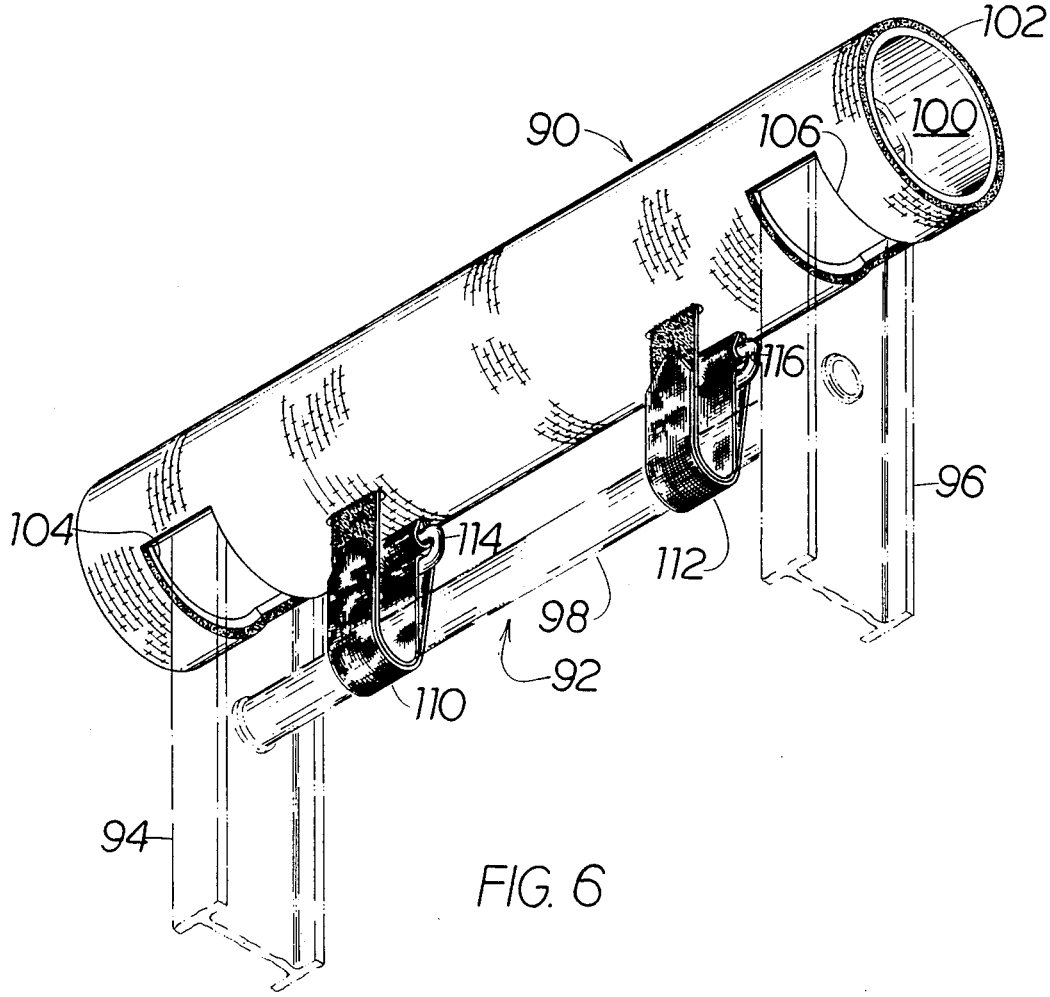
FIG. 6 is a perspective view of another embodiment of structure for the present invention.

FIG. 6 illustrates a relatively simplified and inexpensive embodiment of the present invention. A ladder safety device 90 is shown mounted in its operational position on a ladder 92. The ladder 92 comprises stiles 94 and 96, with an end rung 98. The device 90 includes an elongated cylindrical body having the same general construction and configuration as the body of devices 10 and 60 heretofore described. An inner normally rigid cylindrical tubing section 100 is encased in a resilient rubberized sheath 102. Rectilinear openings 104 and 106 are provided through the body of device 90 to enable insertable registration of the ends of stiles 94 and 96. A means of removably retaining the device 90 on the ladder 92 includes a pair of "Velcro" straps 110 and 112, adjustable as to length, which utilize rigid elongated connectors 114 and 116.

Figure 9:
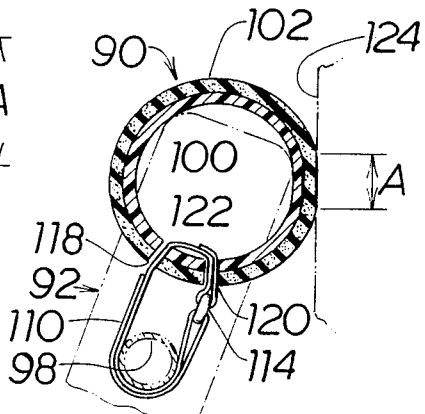
FIG. 9 is a view in vertical section taken on FIG. 8 and showing a comparatively different disposition for securement means of the device.
Figure 8:
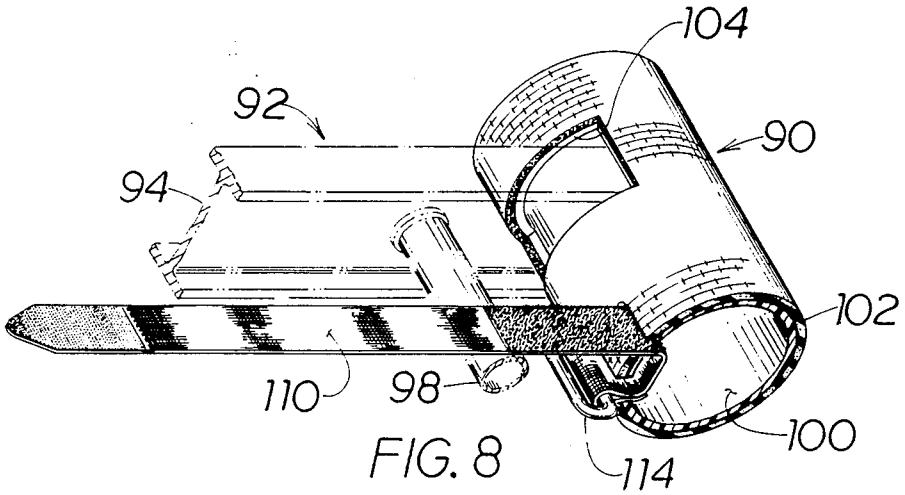
FIG. 8 is a sectional view taken from an upward perspective on FIG. 7.
Figure 7:
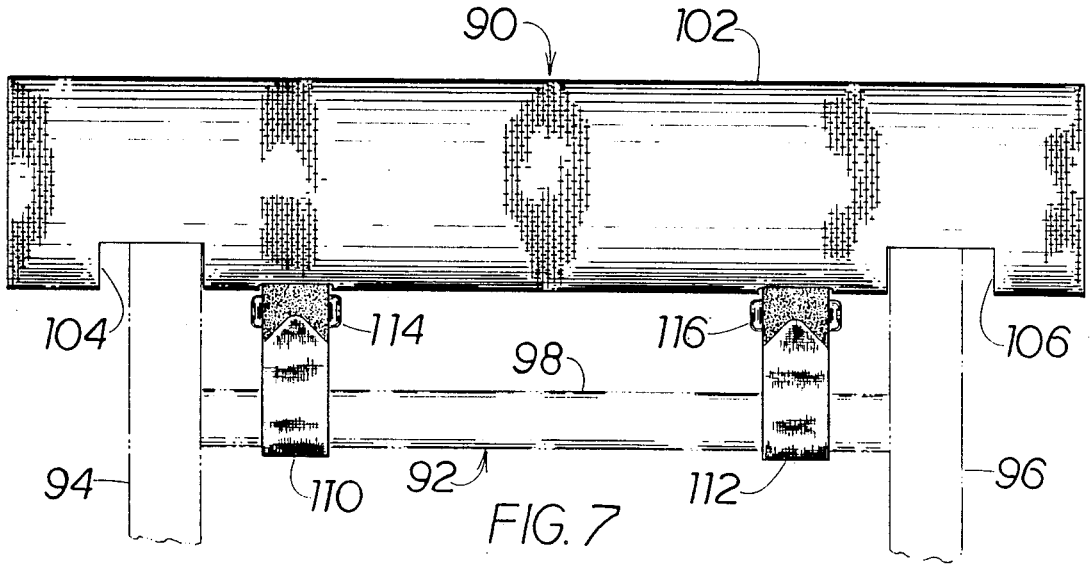
FIG. 7 is a front elevational view of the embodiment first shown in FIG. 6.

FIGS. 7, 8, and 9 show a comparatively modified strap configuration for the device 90, with the strap 110 shown in an open disconnected position in FIG. 8 and in a closed connected position in FIGS. 7 and 9. FIG. 9 also shows that the body of device 90 is provided, for each strap 110 and 112 (FIG. 6), with accommodating slots through the sheath 102 and inner tubular section 100, as indicated by slots 118 and 120. Each of the straps 110 and 112 is fixed relative to the tubular member to be non-slidable. As shown in FIG. 9 with reference to strap 110, one end of the strap is folded back and sewn to form a loop 122 which is joined to one side of the endless rigid connector 114. The loop 122 is fixed firmly in the accommodating slot 120 and the strap extends from the loop laterally across the inside surface of the section 100 and down through slot 118. In its disconnected disposition, the strap 118 appears as shown in FIG. 8 ready to be taken around the rung 98 so that its end can be fed through the connector 114. The strap is then pulled at its end to tension it around the rung 98 and then the strap end is firmly pressed against the strap body to form the gripping connection shown in FIG. 9. By this strap design, the distance between the ladder end rung and the device 90 can vary and the pair of straps 110 and 112 will adjust accordingly to hold the device 90 in its mounted position on the ladder.

With reference to FIG. 7, it will be seen that the openings 104 and 106 may be intentionally given a width, as considered longitudinally on the tubular member, that adapts the device 90 for use on ladders of differing widths from stile to stile. Commercially available ladders vary from a small size where the distance from stile center to stile center is $15\frac{1}{4}$ inches to a large size where the same distance is 17 inches. On the smaller ladder, the stile width may be as small as $\frac{7}{8}$-inch whereas on the larger ladder the stile width can be as much as two inches. Hence, if the distance from the inner edge of opening 104 to the inner edge of opening 106 is $16\frac{1}{8}$ inches, and the distance from the outer edge of opening 104 to the outer edge of opening 106 is 19 inches, then commercial ladders from the smaller to the larger sizes will be accommodated by the device 90, providing the device with universal application regardless of which size ladder is utilized.

II. Function

The device 10 shown in FIGS. 1 through 3, or device 60 shown in FIGS. 4 and 5, or device 90 shown in FIGS. 6, 7, and 8, can be manufactured to enable the user to adaptively fit the device to ladder structures which differ in their basic material of construction or in specific ladder design. The laterally disposed openings in the sidewall of the body of the device may be of sufficient length and breadth to fitably align with ladders of various rung widths, and the circular interior of the rigid tubing 20 will conformably adapt to different stile end shapes.

Although the length of the body in the several illustrated embodiments is shown as exceeding the width of the ladder on which it is used by approximately one stile width at each end, the body length can be extended considerably more to provide an even greater surface contact area, without departing from the basic invention structure, to thereby provide significantly enhanced ladder stabilization where the ladder is to be leaned on a flat building wall surface.

It is intended that the sleeve or sheath, such as sheath 22 in FIG. 1, be of a resilient sponge-like rubber material to resist moisture absorption but to, nevertheless, provide a significant cushioning effect to substantially reduce the possibility of scuffing or marring the appearance finish of the resting surface. Sufficient thickness of the sheath combined with its resilient characteristic and a high-friction outer sheath surface will enable slip resistance that increases proportionately to the weight of the user on the ladder. This will be true regardless of the angle of disposition of the ladder relative to the resting surface because the circular configuration of the body, provided by the tubular shape, assures contact and requires no adjustment of the position of the device in relation to the angle of the ladder.

With specific reference to the embodiment shown in FIG. 1, 2, and 3, a feature of the illustrated structure is the manner of slitting the sheath 22, where it overlies the openings 24 and 26, to form flexible sheath material flaps 40, 42, 44, and 46 which will fold inwardly in response to installation of the device 10 on a ladder. More specifically, as shown in FIG. 1, each of the ends of the respective stiles 14 and 16, by their insertion into the respective openings 24 and 26, cause the aforementioned sheath material flaps to fold inwardly (see FIG. 2) and constitute a contiguous cushion against the adjacent stile surface. Even where the size of the stile, in its width or breadth, is smaller than the opening into which it is inserted, the presence of the flaps will tend to align the stile centrally within the accommodating opening in the body of device 10.

With respect to the embodiment illustrated in FIGS. 4 and 5, it is contemplated that a single central strap or other means of removably fastening the device 60 to the ladder 62 could be utilized, however, in practice it has been found that the spreading of the pulling force obtained by utilization of spacedapart straps 86 and 88, as shown, avoid undesirable shape distortion of the device body which tends to occur where a single attachment means is provided at a central point on the rung 68 and connected to a single point on the body of device 60.

In any of the various embodiments of the invention structure shown in the accompanying drawings, a primary functional feature of the disclosed ladder safety device is the tendency of the body portion or tubular member to temporarily laterally distort during use but to otherwise hold its normal cylindrical shape when not in use. To explain this function, reference is made primarily hereinafter to device 90 shown in FIGS. 6, 7, 8, and 9, but it should be understood that the same operational characteristics are inherent in the embodiments of the invention structure hereinbefore referred to as devices 10 and 60.

Figure 10:
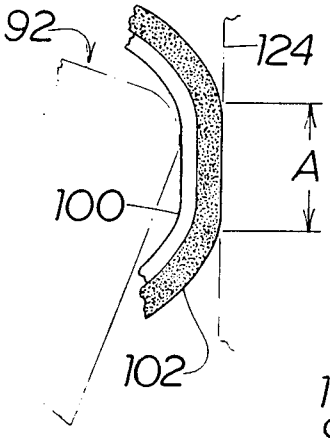
FIG. 10 is a schematic representation of a feature of the structure of the present invention.

The inner tubular section 100 is preferably formed from polyvinylchloride tubing having a 3/16-inch wall thickness and an inside diameter of approximately four inches. Such tubing, when adapted for use in the device 90, is normally rigid but when secured in position on the ladder 92 is capable of limited lateral deformation, generally in the area A identified in FIGS. 9 and 10, in response to the weight of a person on the ladder causing a force to be exerted through the upper stile ends and against the inside surface of the section 100. Such force causes a squeezing action to occur longitudinally along the tubular member and creates a flattened area of registration where the device contacts the wall, building, or other resting surface 124 against which the ladder 92 is being used. The greater the weight of the individual on the ladder, the greater force that is applied interiorally to section 100 whereby correspondingly greater distortion occurs to create a proportionately larger area A of registration between the device 90 and the resting surface 124. This effect is schematically emphasized in FIG. 10. As soon as the individual's body weight is removed from the ladder, the temporarily distorted section 100 resumes its circular configuration until such time as the ladder is again put to use as heretofore described whereupon the described distortion will reoccur to provide a flat frictional area of engagement between the resting surface and the device 90 which increases the total area of registration as a function of the weight of the individual on the ladder.

It is anticipated that modifications or variations may hereafter be made in the structure of the present invention which may depart from the preferred embodiments illustrated in the accompanying drawings, and it is intended that all such modifications or equivalent variations be included within the scope of the appended claims.

I claim:

1. A safety device for mounting on the end of a ladder, of the type having a pair of parallel stiles and equidistantly-spaced rungs, comprising:

an elongated tubular member having a uniform diameter and having a pair of spaced sidewall openings enabling lateral insertion therein of the ladder upper stile ends;

the tubular member comprising an inner tubular section and an outer deformable slip-resistant sleeve;

the openings each being of sufficient size to accept the stile ends therethrough whereby the stile ends contact an inner surface of the tubular section;

the tubular member having a normally fixed body shape that is susceptible to temporary lateral body deformation in response to the ladder being placed in position for use with the safety device in surface contact with a building wall or other resting surface; and the tubular member temporarily forming, where the tubular member is in surface contact with the resting surface, a flattened area of registration the size of which is a function of the force applied through the upper stile ends to the inside surface of the tubular member in response to a person mounting the ladder.

2. The safety device of claim 1 further including securement means for removably securing the tubular member in position on the ladder.

3. The safety device of claim 2 wherein the securement means is fully contained within the tubular member.

4. The safety device of claim 2 wherein the securement means comprises spaced-apart straps extending from the tubular member, the straps having means for removable connection to the first adjacent ladder rung when the safety device is mounted on the end of a ladder.

5. The safety device of claim 2 wherein the securement means includes at least one elongated rigid rod mounted within the tubular member and extending generally between the stile ends.

6. The safety device of claim 5 wherein the rod is attached directly to the stiles.

7. The safety device of claim 2 wherein the securement means includes: first and second elongated rods oriented parallel to each other and extending transversely between the openings, the first rod being contained within the tubular member, the second rod being disposed outwardly adjacent the tubular member, and fastening means connecting the adjacent ends of the first and second rods.

8. The safety device of claim 7 further including releasable strap means for extension from the second rod to the rung of the ladder most closely adjacent the tubular member.

9. The safety device of claim 7 wherein the fastening means comprises two fasteners, each located in one of the openings in the tubular member.

10. The safety device of claim 1 wherein the sleeve is fully coextensive with the inner tubular section, the openings are in the inner tubular section, and the sleeve includes integral flap portions overlying the openings and adapted to fold inwardly as a function of insertion of ladder stiles in the openings.

* * * * *